US011293243B2

(12) United States Patent
Rodriguez et al.

(10) Patent No.: US 11,293,243 B2
(45) Date of Patent: Apr. 5, 2022

(54) HYDRAULIC RETRIEVING TOOL WITH DRIFTING CAPABILITIES

(71) Applicant: Halliburton Energy Services, Inc., Houston, TX (US)

(72) Inventors: Franklin Charles Rodriguez, Hafrsfjord (NO); Morten Falnes, Sola (NO); Neil Hepburn, Newcastle (GB)

(73) Assignee: Halliburton Energy Services, Inc., Houston, TX (US)

( * ) Notice: Subject to any disclaimer, the term of this patent is extended or adjusted under 35 U.S.C. 154(b) by 2 days.

(21) Appl. No.: 16/915,554

(22) Filed: Jun. 29, 2020

(65) Prior Publication Data

US 2021/0404275 A1 Dec. 30, 2021

(51) Int. Cl.

| | |
|---|---|
| ***E21B 23/00*** | (2006.01) |
| ***E21B 41/00*** | (2006.01) |
| ***E21B 47/09*** | (2012.01) |

(52) U.S. Cl.

CPC ..... *E21B 23/00* (2013.01); *E21B 41/0035* (2013.01); *E21B 47/09* (2013.01)

(58) Field of Classification Search

CPC ..... E21B 23/00; E21B 41/0035; E21B 47/09
See application file for complete search history.

(56) References Cited

U.S. PATENT DOCUMENTS

| | | | |
|---|---|---|---|
| 6,405,804 | B1 | 6/2002 | Ohmer et al. |
| 6,488,090 | B1 | 12/2002 | Ohmer |
| 7,413,020 | B2 | 8/2008 | Carter et al. |
| 7,810,568 | B2 | 10/2010 | Toulouse |

(Continued)

FOREIGN PATENT DOCUMENTS

| | | | |
|---|---|---|---|
| AU | 779410 | B2 | 1/2005 |
| CN | 203463058 | U | 3/2014 |
| CN | 104358518 | A | 2/2015 |
| CN | 204627548 | U | 9/2015 |

(Continued)

OTHER PUBLICATIONS

International Search Report and Written Opinion issued for corresponding International PCT Patent Application No. PCT/US2020/040510; dated Mar. 22, 2021.

(Continued)

*Primary Examiner* — Christopher J Sebesta
*Assistant Examiner* — Lamia Quaim
(74) *Attorney, Agent, or Firm* — McGuireWoods LLP

(57) ABSTRACT

Methods and apparatus for installing a deflector in a primary wellbore and confirming lateral wellbore access. The hydraulic retrieving tool is coupled to the interior of the deflector and introduced into the primary wellbore. The hydraulic retrieving tool comprises a bullnose, a plurality of retractable deflective pads, and a retractable dog. The deflector comprises a deflection surface. The hydraulic retrieving tool is decoupled from the interior of the deflector at a depth in the primary wellbore by retracting the dog and the plurality of deflective pads. The hydraulic retrieving tool is removed from the interior of the deflector. The dog and the plurality of deflective pads on the hydraulic retrieving tool are expanded when the hydraulic retrieving tool is removed from the interior of the deflector. The hydraulic retrieving tool drifts at least a portion of the deflection surface to determine if there is lateral wellbore access.

20 Claims, 7 Drawing Sheets

(56) References Cited

U.S. PATENT DOCUMENTS

| | | | | |
|---|---|---|---|---|
| 2003/0150612 | A1* | 8/2003 | McGarian | E21B 47/09 166/255.2 |
| 2003/0205379 | A1 | 11/2003 | Steele et al. | |
| 2005/0230151 | A1* | 10/2005 | McGarian | E21B 41/0042 175/61 |
| 2005/0279506 | A1* | 12/2005 | McKee | E21B 34/10 166/375 |
| 2009/0133877 | A1 | 5/2009 | Neff | |
| 2014/0238701 | A1* | 8/2014 | Rosas | E21B 33/1277 166/387 |
| 2015/0369015 | A1 | 12/2015 | Rastegar | |
| 2016/0245046 | A1 | 8/2016 | Butler et al. | |
| 2016/0333661 | A1* | 11/2016 | Sallwasser | E21B 34/14 |

FOREIGN PATENT DOCUMENTS

| | | | |
|---|---|---|---|
| EP | 1567746 | B1 | 9/2007 |
| WO | 2007008947 | A1 | 1/2007 |
| WO | 2018125071 | A1 | 7/2018 |

OTHER PUBLICATIONS

Langley, "Multilateral Completions On Rise But Still A Niche", Drilling Contract 2011 (see pp. 1-2).

* cited by examiner

HYDRAULIC RETRIEVING TOOL WITH DRIFTING CAPABILITIES

TECHNICAL FIELD

The present disclosure relates generally to wellbore operations, and more particularly, to the use of a hydraulic retrieving tool for installing and confirming the depth and orientation of a deflector in a primary wellbore so as to ensure access to a lateral wellbore.

BACKGROUND

A multilateral well completion may include a primary wellbore extending vertically or horizontally in a subterranean formation. A casing string may be disposed in the primary wellbore. In some examples, a layer of cement may be disposed in the annulus between the casing string and the inside diameter of the primary wellbore. An exit window in the casing string may be used for drilling a lateral or secondary wellbore from the primary wellbore. Access to the lateral wellbore is important for lateral wellbore operations.

The deflection of any wellbore tools into the lateral wellbore is necessary to orient the wellbore tools from the primary wellbore into the desired lateral wellbore. A deflector may be installed within the primary wellbore at a location adjacent to the desired lateral wellbore. The surface of the deflector is tapered toward the lateral window to provide a transition surface to orient a wellbore tool toward the desired lateral wellbore. Provided are improvements to lateral wellbore operations through the use of a hydraulic retrieving tool to install and confirm the depth and orientation of a deflector in a primary wellbore in order to ensure access to a lateral wellbore.

BRIEF DESCRIPTION OF THE DRAWINGS

Illustrative examples of the present disclosure are described in detail below with reference to the attached drawing figures, which are incorporated by reference herein, and wherein.

Figure 1A:
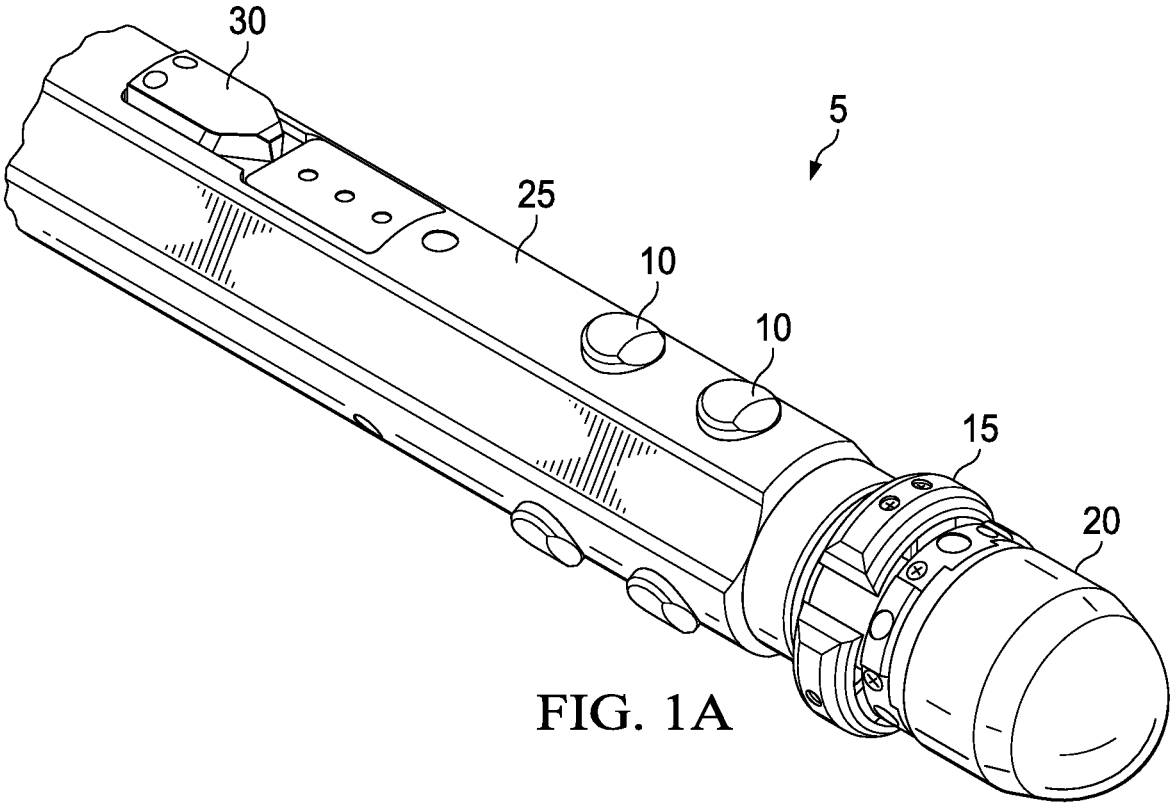
FIG. 1A illustrates a perspective view of an example hydraulic retrieving tool in the expanded mode of operation, in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to the use of a hydraulic retrieving tool for installing and confirming the depth and orientation of a deflector in a primary wellbore so as to ensure access to a lateral wellbore.

In the following detailed description of several illustrative examples, reference is made to the accompanying drawings that form a part hereof, and in which is shown by way of illustration, examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

As used herein, the term "formation" encompasses the term "reservoir," referring to a portion of the formation which has sufficient porosity and permeability to store or transmit fluids (e.g., hydrocarbons). As used herein, the term "fracturing fluid" refers generally to any fluid that may be used in a subterranean application in conjunction with a desired function and/or for a desired purpose. The term "fracturing fluid" does not imply any particular action by the fluid or any component thereof.

The examples described herein relate to the use of a hydraulic retrieving tool to install and confirm the depth and orientation of a deflector in a primary wellbore so as to ensure access to a lateral wellbore. The hydraulic retrieving tool is coupled to the deflector upon introduction into the primary wellbore. The hydraulic retrieving tool comprises at least one dog and a plurality of deflective pads. The dog and the deflective pads are retractable. When the dog and the deflective pads are retracted, the outer diameter of the hydraulic retrieving tool is of sufficiently small size so as to allow for the hydraulic retrieving tool to be inserted or removed from the interior of the deflector. When the dog and the deflective pads are expanded, the outer diameter of the hydraulic retrieving tool is of a sufficiently large size so as to prevent the insertion or removal of the hydraulic retrieving tool from the interior of the deflector. Advantageously, when the hydraulic retrieving tool is removed from the installed deflector, the hydraulic retrieving tool, in its expanded mode of operation, is usable to drift at least a portion of the deflector surface of the deflector. If the hydraulic retrieving tool is able to successfully drift the deflection surface to confirm lateral access, the hydraulic retrieving tool may then be removed from the primary wellbore and a wellbore tool may be inserted into the lateral wellbore to conduct a lateral wellbore operation. Conversely, if the hydraulic retrieving tool drifts a portion of the deflection surface, but gets stuck and is unable to confirm lateral access, the hydraulic retrieving tool may be reinserted into the interior of the deflector where it may be recoupled to the deflector. The deflector may then be retrieved from the wellbore and a different size deflector may be tried for lateral access. Advantageously, the installation and confirmation of lateral access is conducted in a single wellbore trip. As a further advantage, the hydraulic retrieving tool allows for the retrieval of a deflector in the event that the lateral access is not confirmed.

Figure 1B:
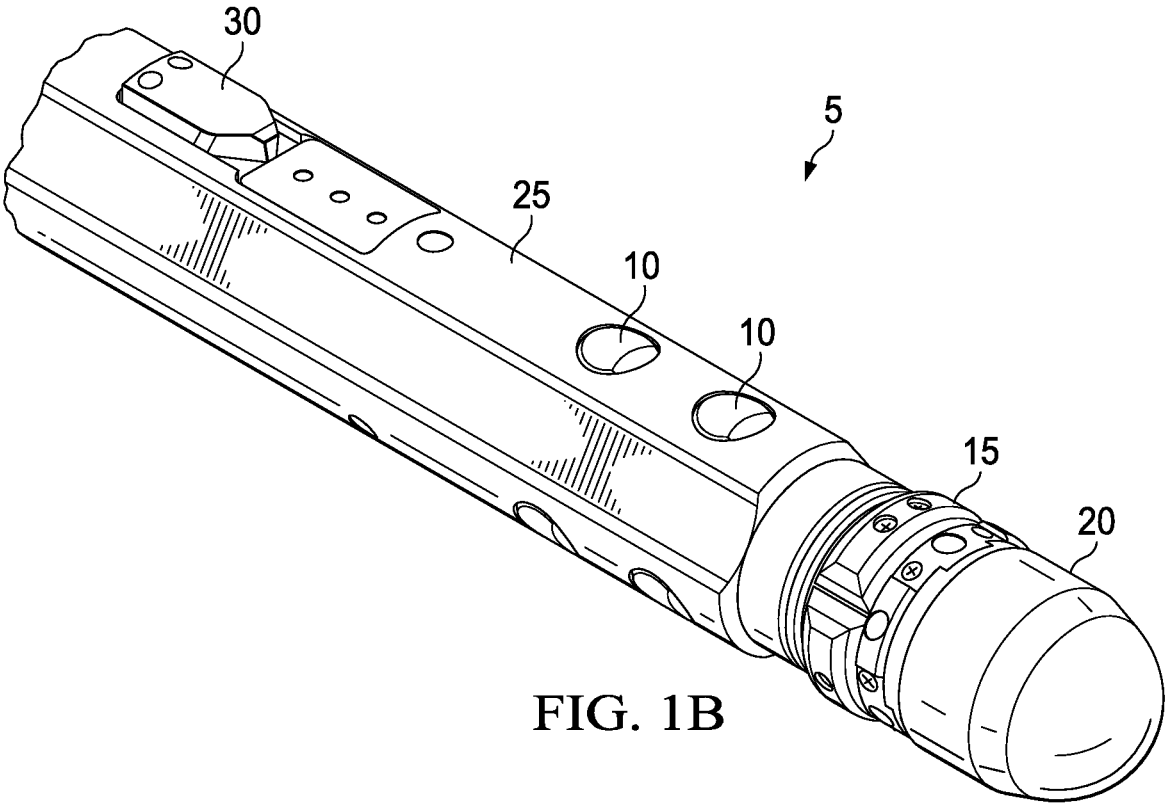
FIG. 1B illustrates a perspective view of an example hydraulic retrieving tool in the retracted mode of operation, in accordance with one or more examples described herein.

FIGS. 1A and 1B illustrate a perspective view of the hydraulic retrieving tool 5. FIG. 1A illustrates the hydraulic retrieving tool 5 when the dogs 10 and deflective pads 15 are expanded. FIG. 1B illustrates the hydraulic retrieving tool 5 when the dogs 10 and deflective pads 15 are retracted. The hydraulic retrieval tool 5 comprises at least one dog 10, a plurality of deflective pads 15, a bullnose 20, a housing 25, and an alignment key 30. The dogs 10 are expandable/retractable within the housing 25. Although two dogs 10 are illustrated, it is to be understood that in some alternative examples, only one dog 10 may be provided. In other alternative examples, more than two dogs 10 may be provided. As illustrated in FIG. 1A, the dogs 10 are pistons that are expandable and extend out of the housing 25. When expanded, the dogs 10 will extend into corresponding chambers present in the interior of a deflector (not illustrated). The expanded dogs 10 assist in coupling the hydraulic retrieving tool 5 to the interior of the deflector when the deflector is run in the wellbore, or when the deflector is retrieved from the wellbore. As illustrated in FIG. 1B, the dogs 10 are retractable and retract into the housing 25. When retracted, the dogs 10 decouple the hydraulic retrieving tool 5 from the interior of the deflector (not illustrated). The hydraulic retrieving tool 5 is then able to be removed/inserted within the interior of the deflector.

The plurality of deflective pads 15 are expandable/retractable. In some optional examples, the deflective pads 15 may be coupled to the same mechanism that expands/retracts the dogs 10 so that the two components may be actuated in unison. In alternative examples, the dogs 10 and the deflective pads 15 may be actuated independently of one another. The deflective pads 15 may assist the dogs 10 in coupling and retaining the hydraulic retrieving tool 5 in the interior of the deflector when the deflective pads 15 are in the expanded state. Likewise, the hydraulic retrieving tool 5 may not be inserted or removed from the interior of the deflector when the deflective pads 15 are in the expanded stated. After the hydraulic retrieving tool 5 is removed from the interior of the deflector, the deflective pads 15 are expanded. The expanded deflective pads 15 do not allow for reinsertion of the hydraulic retrieving tool 5 into the interior of the deflector as their outer diameter in the expanded state is greater than the inner diameter of the interior of the deflector. As such, the deflective pads 15 deflect the hydraulic retrieving tool 5 over the deflection surface of the deflector. If the deflector is in the correct orientation and depth, the deflected hydraulic retrieving tool 5 will be able to drift the deflector to access the lateral window. If the deflector is not in the correct orientation and depth, the deflected hydraulic retrieving tool 5 will be able to drift only a portion of the deflector before getting stuck and will not be able to access the lateral window. The deflective pads 15 are illustrated as generally rectangular, but may comprise any shape as would be readily apparent to one of ordinary skill in the art. Examples of shapes include, but are not limited to, parallelogram, rhombus, trapezoid, the like, and any combination thereof.

As illustrated by FIGS. 1A and 1B, the expanded and retracted modes of operation for the dogs 10 and the deflective pads 15 are convertible, and the individual modes of operation may be readily converted to one another when desired by an operator.

With continued reference to FIGS. 1A and 1B, the bullnose 20 of the hydraulic retrieving tool 5 is a rounded convex shape. The bullnose 20 shape may assist in drifting the deflector with the hydraulic retrieving tool 5. The bullnose 20 shape may also assist in insertion of the hydraulic retrieving tool 5 into the interior of the deflector. In alternative examples, the bullnose 20 may be substituted for other specialized shape leads for the hydraulic retrieving tool 5, such as conical, pyramidal, frustum, etc.

The housing 25 may comprise a generally cylindrical shape. The housing 25 may comprise any material sufficient for orienting and retrieving a deflector in a wellbore. The alignment key 30 is disposed in the housing 25. The alignment key 30 assists in aligning the hydraulic retrieving tool 5 in the interior of the deflector so that the dogs 10 and other components of the hydraulic retrieving tool 5 are in proper alignment with any corresponding component of the interior of the deflector, e.g., the chambers of the deflector in which the dogs 10 may extend.

Figure 2A:
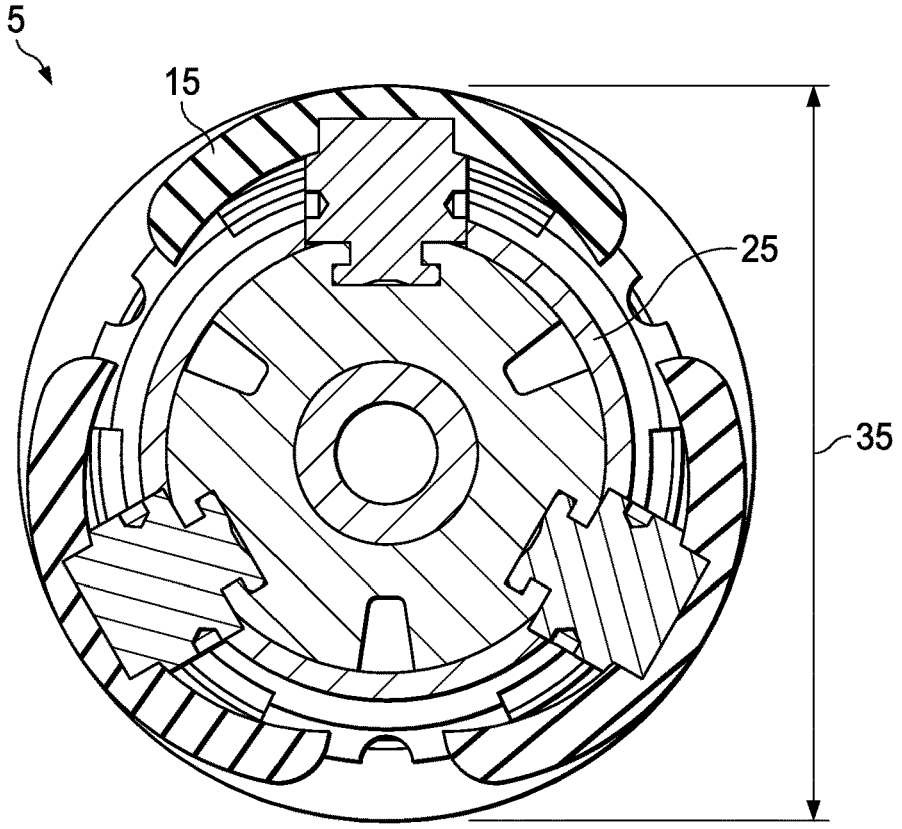
FIG. 2A illustrates a cross-sectional view of the hydraulic retrieving tool as cut along the deflective pads when the hydraulic retrieving tool is in the expanded mode of operation, in accordance with one or more examples described herein.
Figure 2B:
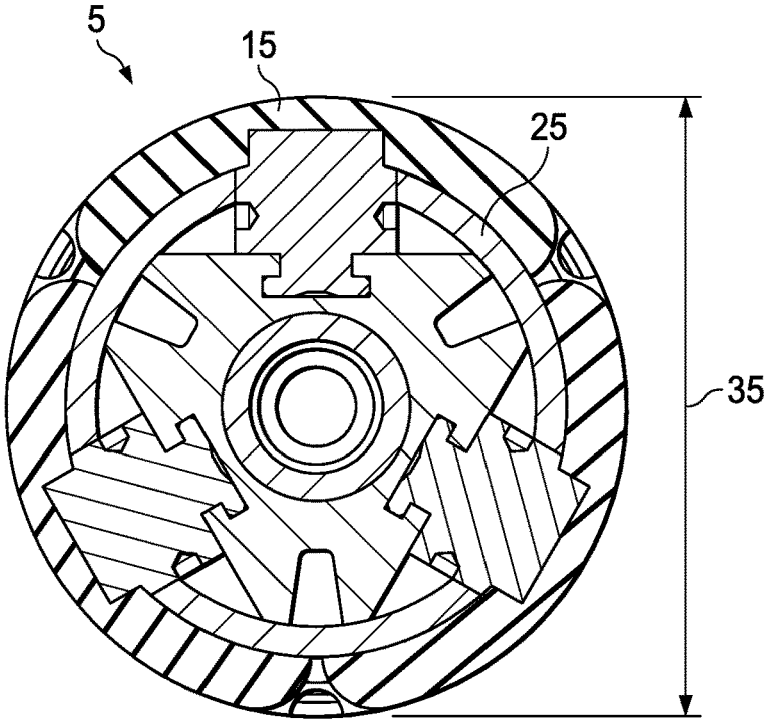
FIG. 2B illustrates a cross-sectional view of the hydraulic retrieving tool as cut along the deflective pads when the hydraulic retrieving tool is in the retracted mode of operation, in accordance with one or more examples described herein.

FIGS. 2A and 2B illustrate a cross-sectional view of the hydraulic retrieving tool 5 as cut along the deflective pads 15. As illustrated, FIG. 2A illustrates the hydraulic retrieving tool 5 when the deflective pads 15 are in the expanded mode of operation. FIG. 2B illustrates the hydraulic retrieving tool 5 when the deflective pads 15 are in the retracted mode of operation. The outer diameter 35 of the hydraulic retrieving tool 5 is increased in FIG. 2A relative to FIG. 2B due to the expansion of the deflective pads 15 in FIG. 2A. FIGS. 2A and 2B illustrate a plurality of three deflective pads 15. It is to be understood that in some examples, less than or more than three deflective pads 15 may be used.

Figure 3A:
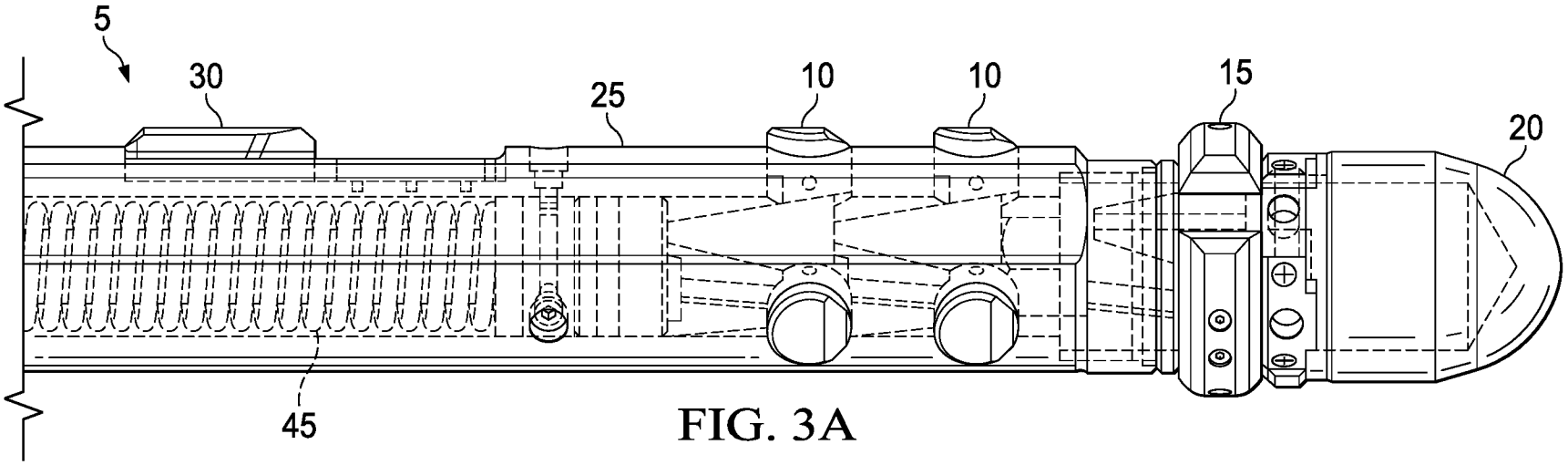
FIG. 3A illustrates a cross-sectional view of the hydraulic retrieving tool as cut along its axis when the hydraulic retrieving tool is in the expanded mode of operation, in accordance with one or more examples described herein.
Figure 3B:
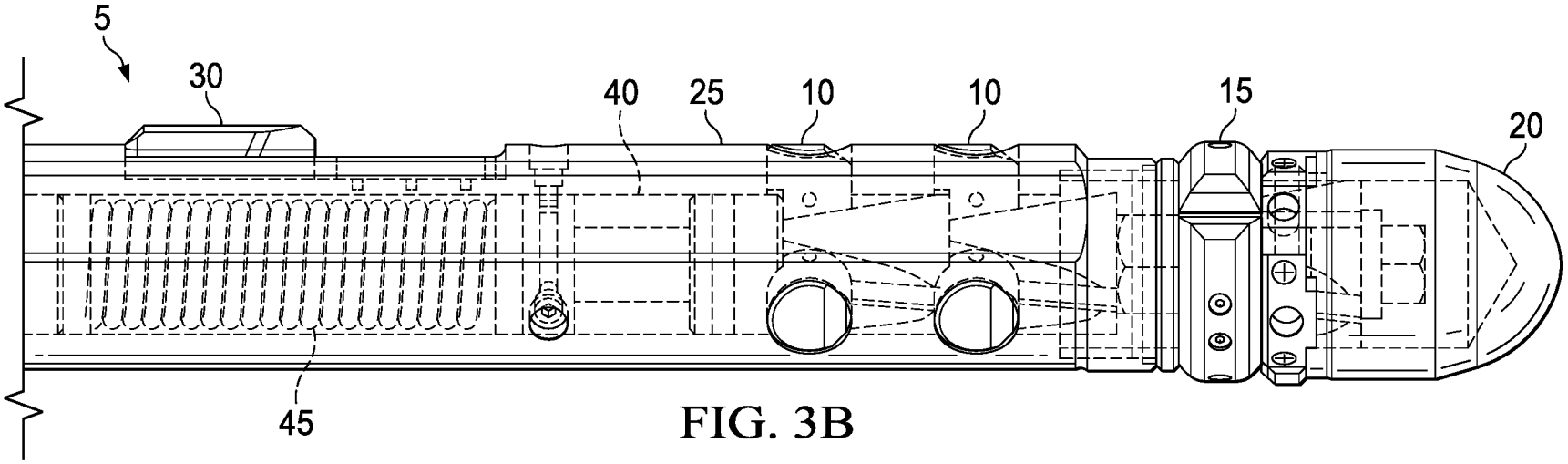
FIG. 3B illustrates a cross-sectional view of the hydraulic retrieving tool as cut along its axis when the hydraulic retrieving tool is in the retracted mode of operation, in accordance with one or more examples described herein.

FIGS. 3A and 3B illustrate a cross-sectional view of the hydraulic retrieving tool 5 as cut along its axis. The internal arrangement of the dogs 10, deflective pads 15, bullnose 20, and alignment key 30 are visible within the housing 25. FIG. 3A illustrates the hydraulic retrieving tool 5 when the dogs 10 and the deflective pads 15 are in the expanded mode of operation. FIG. 3B illustrates the hydraulic retrieving tool 5 when the dogs 10 and the deflective pads 15 are in the retracted mode of operation. A mandrel 40 is visible within the housing 25 in FIG. 3B. In FIG. 3A, the mandrel 40 is obscured by a coil 45. In FIG. 3A, no pressure is applied and the mandrel 40 (obscured) is retracted within coil 45. As the mandrel 40 is retracted or moved to the left in the illustration, the dogs 10 and the deflective pads 15 are consequently expanded. In FIG. 3B, pressure is applied to the mandrel 40, and the mandrel 40 is extended to the right in the illustration. The extended mandrel 40 retracts the dogs 10 and the deflective pads 15. When the pressure is removed from the mandrel 40, the dogs 10 and the deflective pads 15 revert to the expanded mode of operation illustrated in FIG. 3A.

Figure 4:
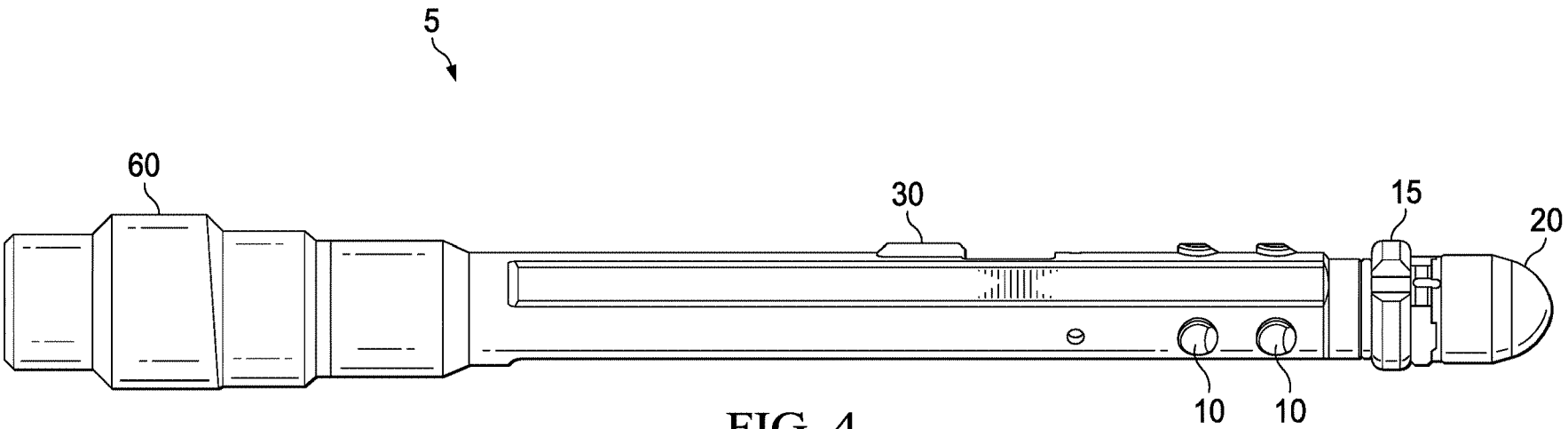
FIG. 4 illustrates a perspective view of the hydraulic retrieving tool as it is coupled to a drift subassembly, in accordance with one or more examples described herein.

FIG. 4 is a perspective illustration of the hydraulic retrieving tool 5 coupled to a drift subassembly 60. The drift subassembly 60 is an uphole portion of subassembly that drifts the deflection surface of the deflector (not illustrated) to determine if lateral access is present. If the hydraulic retrieving tool 5 is able to drift the deflector surface to the point where the drift subassembly 60 is able to access the lateral wellbore, then lateral access is confirmed and the deflector has been installed at the correct depth and orientation. If the hydraulic retrieving tool 5 becomes stuck and the drift subassembly 60 is not able to drift the deflector surface to access the lateral wellbore, then the deflector has not been installed at the correct depth and orientation. The hydraulic retrieving tool 5 may then be pulled up off of the deflector surface and then reinserted into the deflector by retracting the dogs 10 and the deflective pads 15. Once reinserted into the deflector interior, the dogs 10 and the deflective pads 15 may be expanded and the deflector may be retrieved and exchanged at the surface. Sensors may be affixed to the hydraulic retrieving tool 5 and/or the drift subassembly 60 to measure the progress of the hydraulic retrieving tool 5 and/or the drift subassembly 60 during the drifting aspect of the operation.

Figure 5A:
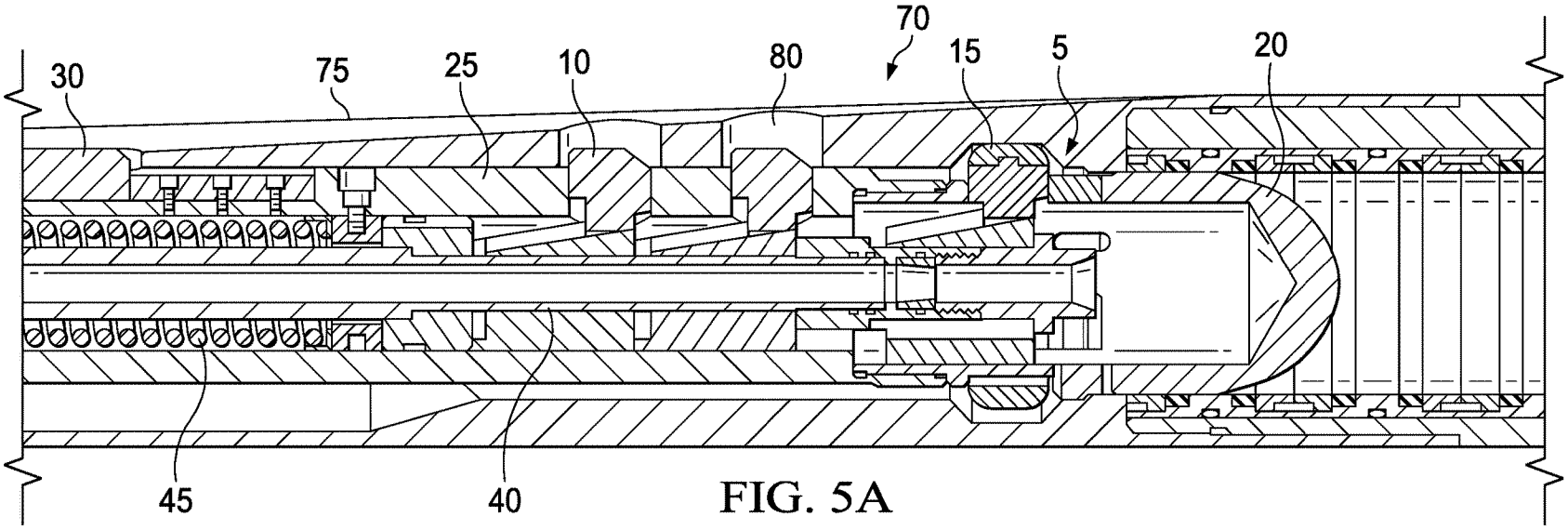
FIG. 5A illustrates a cross-sectional view of the hydraulic retrieving tool as cut along its axis, when the hydraulic retrieving tool is inserted in the deflector and is in the expanded mode of operation, in accordance with one or more examples described herein.
Figure 5B:
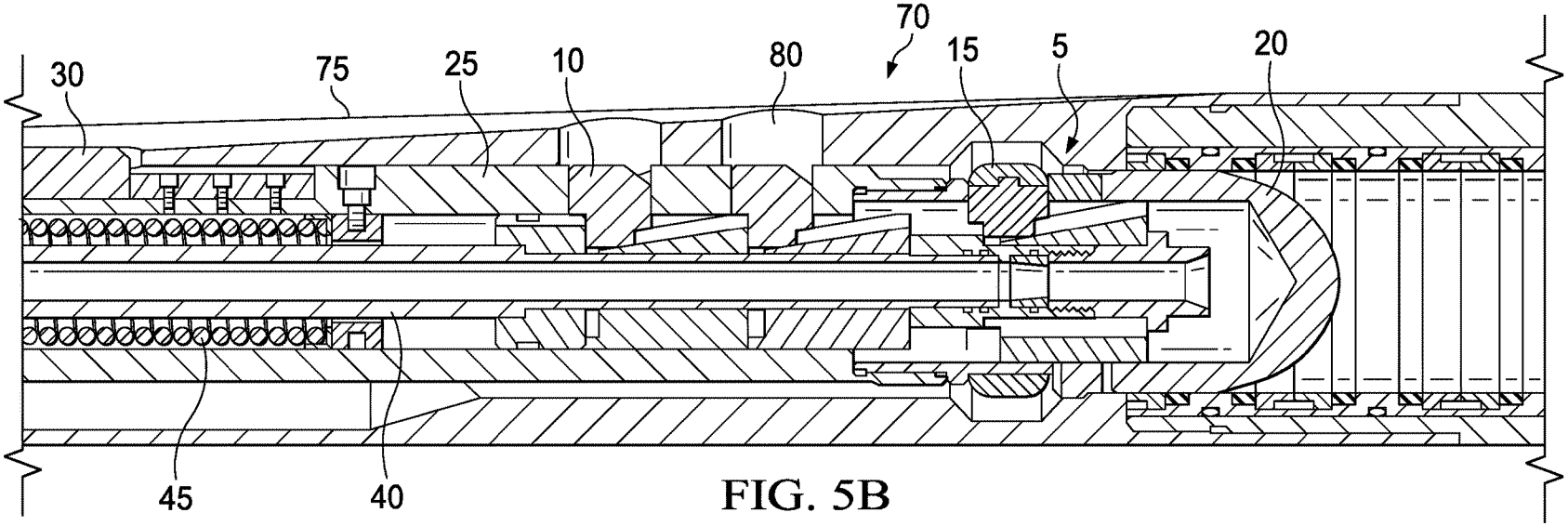
FIG. 5B illustrates a cross-sectional view of the hydraulic retrieving tool as cut along its axis, when the hydraulic retrieving tool is inserted in the deflector and is in the retracted mode of operation, in accordance with one or more examples described herein.

FIGS. 5A and 5B illustrate a cross-sectional view of the hydraulic retrieving tool 5 as inserted within a deflector 70 having a deflection surface 75. FIG. 5A illustrates the hydraulic retrieving tool 5 without pressure applied to the mandrel 40 resulting in the expansion of the dogs 10 and the deflective pads 15 within the interior of the deflector 70. As illustrated, the dogs 10 extend into the chambers 80 of the deflector 70 and retain the hydraulic retrieving tool 5 within the interior of the deflector 70. FIG. 5B illustrates the hydraulic retrieving tool 5 with pressure applied to the mandrel 40 resulting in the retraction of the dogs 10 and the deflective pads 15 within the interior of the deflector 70. As illustrated, the dogs 10 no longer extend into the chambers 80 of the deflector 70, and the hydraulic retrieving tool 5 may be withdrawn from the interior of the deflector 70. Once withdrawn, pressure may be removed from the mandrel 40 to once again expand the dogs 10 and the deflective pads 15. When expanded, the hydraulic retrieving tool 5 may be used to drift at least a portion of the deflection surface 75 of the deflector 70.

FIGS. 6-12 illustrate an example method of the hydraulic retrieving tool 5 as it drifts the deflection surface 75 of the deflector 70.

Figure 6:
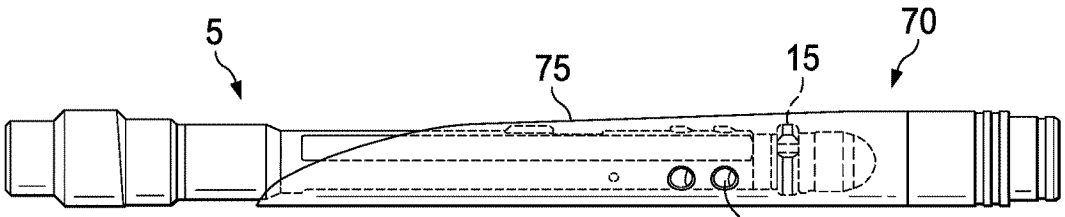
FIG. 6 illustrates a perspective view of the hydraulic retrieving tool coupled to the interior of the deflector as the hydraulic retrieving tool and the deflector are run in the primary wellbore, in accordance with one or more examples described herein.

FIG. 6 illustrates the hydraulic retrieving tool 5 coupled to the deflector 70 as the two components are run into the wellbore together. In the illustration of FIG. 6, the dogs 10 and deflective pads 15 of the hydraulic retrieving tool 5 are expanded within the interior of the deflector 70 to retain the hydraulic retrieving tool 5 within the interior of the deflector 70.

Figure 7:
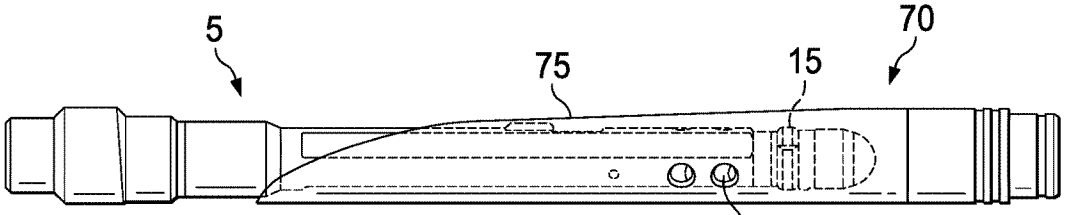
FIG. 7 illustrates a perspective view of the hydraulic retrieving tool as it is decoupled from the interior of the deflector, in accordance with one or more examples described herein.

FIG. 7 illustrates the hydraulic retrieving tool 5 as it is decoupled from the deflector 70. When the deflector 70 is believed to be installed at the correct depth and in the correct orientation to access the lateral window, the hydraulic retrieving tool 5 may be decoupled from the deflector 70 by retracting the dogs 10 and the deflective pads 15 to release the hydraulic retrieving tool 5 from the interior of the deflector 70.

Figure 8:
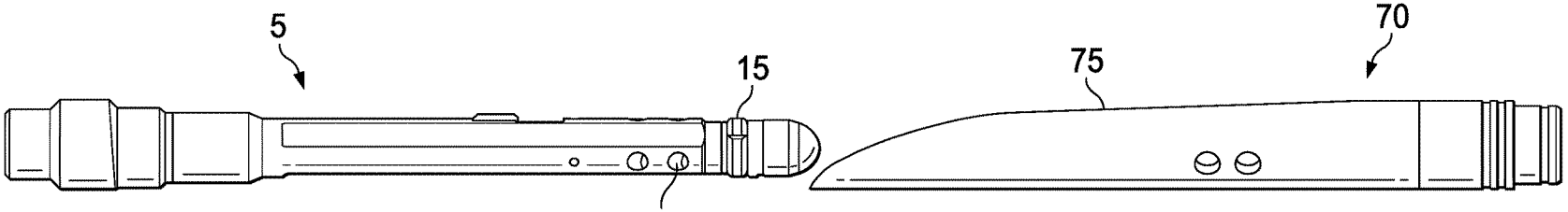
FIG. 8 illustrates a perspective view of the hydraulic retrieving tool as it is removed from the interior of the deflector, in accordance with one or more examples described herein.

FIG. 8 illustrates the hydraulic retrieving tool 5 as it has been released from and pulled out of the interior of the deflector 70. With the dogs 10 and deflective pads 15 retracted, the hydraulic retrieving tool 5 is able to be removed from the interior of the deflector 70. In the illustration of FIG. 8, the dogs 10 and the deflective pads 15 are still retracted.

Figure 9:
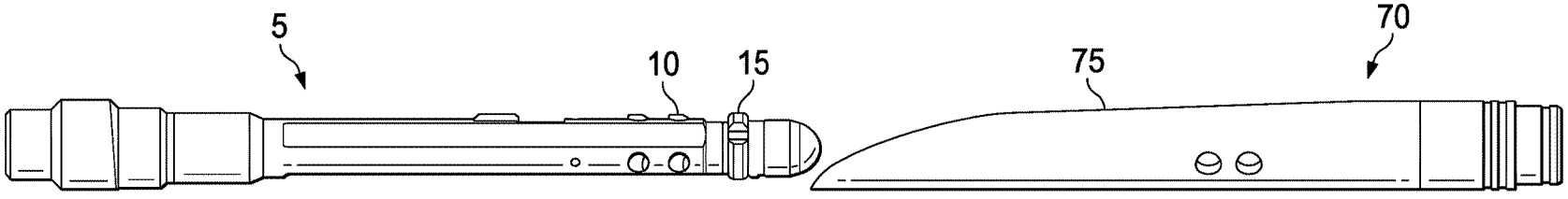
FIG. 9 illustrates a perspective view of the hydraulic retrieving tool as it is transitioned to the expanded mode of operation in preparation to drift the deflection surface of the deflector, in accordance with one or more examples described herein.

FIG. 9 illustrates the hydraulic retrieving tool 5 as it is switching to the drift mode of operation. When the hydraulic retrieving tool 5 is fully removed from the interior of the deflector 70, the deflective pads 15 may be expanded to allow the hydraulic retrieving tool 5 to drift the deflection surface 75 of the deflector 70. The expanded deflective pads 15 prevent the hydraulic retrieving tool 5 from being reinserted into the interior of the deflector 70 and instead assist in deflecting the hydraulic retrieving tool 5 onto the deflection surface 75 of the deflector 70.

Figure 10:
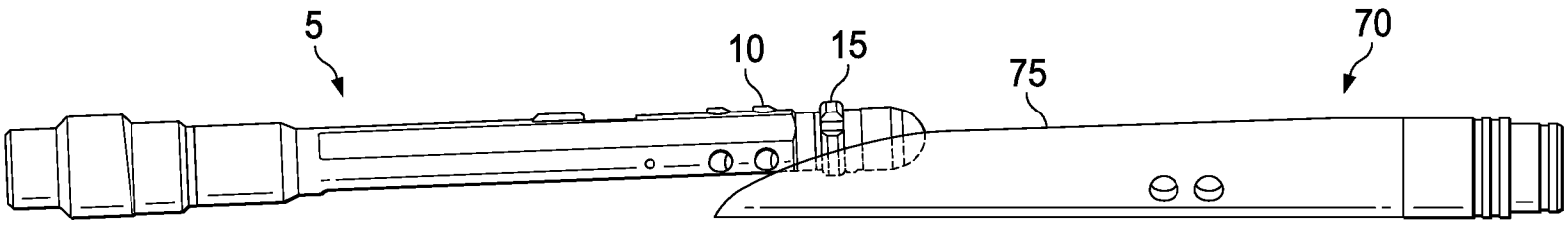
FIG. 10 illustrates a perspective view of the hydraulic retrieving tool as it drifts at least a portion of the deflection surface of the deflector, in accordance with one or more examples described herein.

FIG. 10 illustrates the hydraulic retrieving tool 5 as it contacts the deflection surface 75 of the deflector 70. When the deflective pads 15 are expanded, the hydraulic retrieving tool 5 may be propelled forward to drift at least a portion of the deflector 70. The progress of the hydraulic retrieving tool 5 as it is moved forward may be measured by sensors which measure forward progress of the hydraulic retrieving tool 5.

Figure 11:
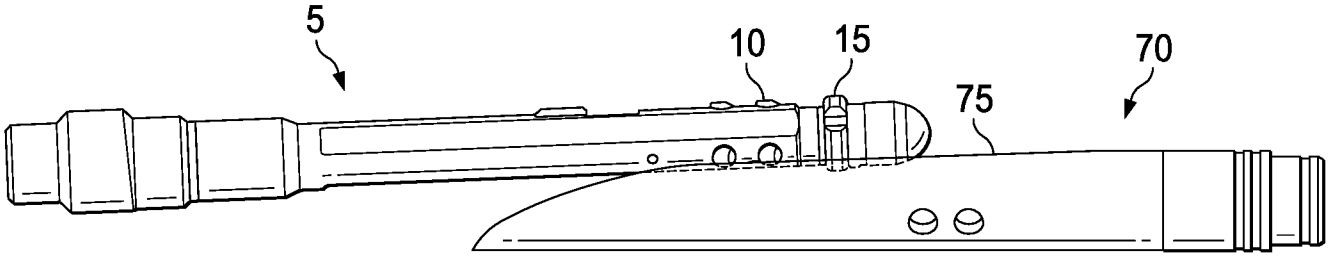
FIG. 11 illustrates a perspective view of the hydraulic retrieving tool as it makes forward progress in drifting at least a portion of the deflection surface of the deflector, in accordance with one or more examples described herein.

FIG. 11 illustrates further progress of the hydraulic retrieving tool 5 as it drifts the deflection surface 75 of the deflector 70. As discussed in FIG. 10, the progress of the hydraulic retrieving tool 5 may be measured in order to determine if it was successful in confirming lateral access.

Figure 12:
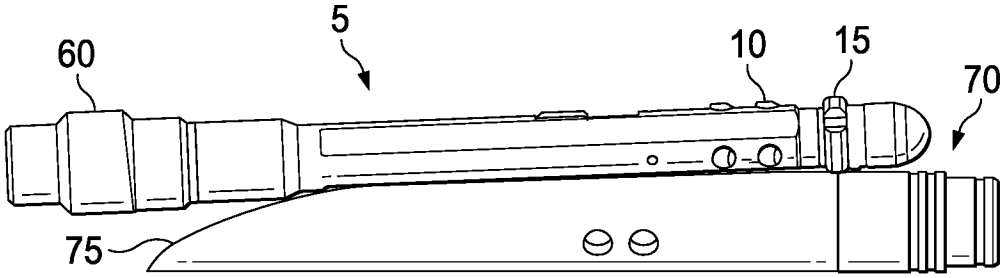
FIG. 12 illustrates a perspective view of the hydraulic retrieving tool as it continues to make further forward progress in drifting at least a portion of the deflection surface of the deflector, in accordance with one or more examples described herein.

FIG. 12 illustrates further progress of the hydraulic retrieving tool 5 as it drifts the deflection surface 75 of the deflector 70. The drift subassembly 60 is approaching the deflection surface 75. If the drift subassembly 60 is able to drift the deflection surface 75, then lateral access is confirmed. If lateral access is confirmed, then the deflector 70 is installed at the correct depth and orientation. The hydraulic retrieving tool 5 may then be removed from the primary wellbore while the deflector 70 remains in place. If at any point the hydraulic retrieving tool 5 becomes stuck and is no longer to make forward progress, then lateral access is not confirmed. The method illustrated by FIGS. 6-12 may be reversed and the hydraulic retrieving tool 5 may be reinserted and recoupled to the interior of the deflector 70. The hydraulic retrieving tool 5 and the coupled deflector 70 may then be withdrawn from the primary wellbore. When withdrawn, the deflector 70 may be exchanged for another size deflector 70 which may be better suited to provide lateral access.

It is to be understood that the hydraulic retrieving tool 5 and its components as depicted in FIGS. 1-12 are only one possible configuration of the hydraulic retrieving tool 5. As such, it is to be recognized that the illustrated hydraulic retrieving tool 5 is merely exemplary in nature, and various additional configurations may be used that have not necessarily been depicted in FIGS. 1-12 in the interest of clarity. Moreover, non-limiting additional components may be present, including, but not limited to, valves, condensers, adapters, joints, gauges, sensors, compressors, pressure controllers, pressure sensors, flow rate controllers, flow rate sensors, temperature sensors, and the like. As such, it should be clearly understood that the examples illustrated by FIGS. 1-12 are merely a general application of the principles of this disclosure in practice, and a wide variety of other examples are possible. Therefore, the scope of this disclosure is not limited in any manner to the details of FIGS. 1-12 as described herein.

It is to be recognized that the hydraulic retrieving tool may also directly or indirectly affect the various downhole equipment and tools that may contact the hydraulic retrieving tool disclosed herein. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the apparatus, methods, and systems generally described above and depicted in FIGS. 1-12.

Provided are methods for installing a deflector in a primary wellbore and confirming lateral wellbore access. An example method comprises introducing a hydraulic retrieving tool coupled to the interior of the deflector in the primary wellbore, the hydraulic retrieving tool comprises a bullnose, a plurality of retractable deflective pads, and a retractable dog. The deflector comprises: a deflection surface. The method further comprises decoupling the hydraulic retrieving tool from the interior of the deflector at a depth in the primary wellbore by retracting the dog and the plurality of deflective pads; removing the hydraulic retrieving tool from the interior of the deflector; expanding the dog and the plurality of deflective pads on the hydraulic retrieving tool when the hydraulic retrieving tool has been removed from the interior of the deflector; and drifting at least a portion of the deflection surface with the hydraulic retrieving tool to determine if there is lateral wellbore access.

Additionally or alternatively, the method may include one or more of the following features individually or in combination. If there is no lateral wellbore access, the method may further comprise reinserting the hydraulic retrieving tool in the interior of the deflector and expanding the dog and the plurality of deflective pads when reinserted. The method may further comprise removing the deflector from the primary wellbore with the hydraulic retrieving tool inserted into the interior of the deflector. If there is lateral wellbore access, the method may further comprise removing the hydraulic retrieving tool from the primary wellbore. A deflective pad in the plurality may comprise a rectangular, parallelogram, rhombus, or trapezoidal shape. The hydraulic retrieving tool may further comprise a mandrel coupled to at least one of the retractable dog and the plurality of deflective pads. The mandrel may actuate the expansion and retraction of at least one of the retractable dog and the plurality of deflective pads. A sensor may be used to determine if the hydraulic retrieving tool accessed the lateral wellbore. A drift subassembly may be coupled to the hydraulic retrieving tool and wherein lateral access is confirmed if the drift subassembly is able to drift at least a portion of the deflection surface of the deflector.

Provided are hydraulic retrieving tools. An example hydraulic retrieving tool comprises a bullnose, a plurality of retractable deflective pads, and a retractable dog.

Additionally or alternatively, the hydraulic retrieving tool may include one or more of the following features individually or in combination. A deflective pad in the plurality may comprise a rectangular, parallelogram, rhombus, or trapezoidal shape. The hydraulic retrieving tool may further comprise a mandrel coupled to at least one of the retractable dog and the plurality of deflective pads. The mandrel may actuate the expansion and retraction of at least one of the retractable dog and the plurality of deflective pads. A sensor may be used to determine if the hydraulic retrieving tool accessed the lateral wellbore. A drift subassembly may be coupled to the hydraulic retrieving tool and wherein lateral access is confirmed if the drift subassembly is able to drift at least a portion of the deflection surface of the deflector.

Provided are systems for installing a deflector in a wellbore and confirming lateral wellbore access. An example system comprises a hydraulic retrieving tool comprising a bullnose, a plurality of retractable deflective pads, and a retractable dog. A deflector comprises a deflection surface.

Additionally or alternatively, the system may include one or more of the following features individually or in combination. A deflective pad in the plurality may comprise a rectangular, parallelogram, rhombus, or trapezoidal shape. The hydraulic retrieving tool may further comprise a mandrel coupled to at least one of the retractable dog and the plurality of deflective pads. The mandrel may actuate the expansion and retraction of at least one of the retractable dog and the plurality of deflective pads. A sensor may be used to determine if the hydraulic retrieving tool accessed the lateral wellbore. The system may further comprise a drift subassembly coupled to the hydraulic retrieving tool and wherein lateral access is confirmed if the drift subassembly is able to drift at least a portion of the deflection surface of the deflector.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A method for installing a deflector in a primary wellbore and confirming lateral wellbore access, the method comprising:

introducing a hydraulic retrieving tool coupled to the interior of the deflector in the primary wellbore, the hydraulic retrieving tool comprising:

a bullnose, a plurality of retractable deflective pads in an expanded state, and a retractable dog in an expanded state;

wherein the deflector comprises:

a deflection surface;

installing the deflector in the wellbore by decoupling the hydraulic retrieving tool from the interior of the deflector at a depth in the primary wellbore by retracting the dog and the plurality of deflective pads from the expanded state; wherein the retraction of the dog and the plurality of deflective pads is performed by pressurizing a mandrel within the hydraulic retrieving tool to shift a position of the mandrel thereby retracting the dog and plurality of deflector;

removing the hydraulic retrieving tool from the interior of the deflector;

expanding the dog and the plurality of deflective pads on the hydraulic retrieving tool when the hydraulic retrieving tool has been removed from the interior of the deflector by removing pressure from the mandrel to revert the position of the mandrel; and drifting at least a portion of the deflection surface with the hydraulic retrieving tool to determine if there is lateral wellbore access.

2. The method of claim 1, wherein the method further comprises reinserting the hydraulic retrieving tool in the interior of the deflector and expanding the dog and the plurality of deflective pads when reinserted.

3. The method of claim 2, further comprising removing the deflector from the primary wellbore with the hydraulic retrieving tool inserted into the interior of the deflector.

4. The method of claim 1, wherein the method further comprises removing the hydraulic retrieving tool from the primary wellbore.

5. The method of claim 1, wherein a deflective pad in the plurality comprises a rectangular, parallelogram, rhombus, or trapezoidal shape.

6. The method of claim 1, wherein a sensor is used to determine if the hydraulic retrieving tool accessed the lateral wellbore.

7. The method of claim 1, wherein a drift subassembly is coupled to the hydraulic retrieving tool and wherein lateral access is confirmed if the drift subassembly is able to drift at least a portion of the deflection surface of the deflector.

8. The method of claim 1, wherein the hydraulic retrieving tool further comprises an alignment key.

9. A hydraulic retrieving tool for installing a deflector, comprising:

a bullnose, a plurality of retractable deflective pads configured to be in an expanded state when positioned within the deflector, a retractable dog configured to be in an expanded state when positioned within the deflector, a mandrel coupled to at least one of the retractable dog and the plurality of deflective pads and configured to retract the deflective pads and the dog when pressurized; wherein the mandrel is configured to be pressurized when the hydraulic retrieving tool is being inserted or removed from the deflector; wherein the mandrel is configured to not be pressurized when the hydraulic retrieving tool is drifting the deflector or being run in the wellbore within the deflector.

10. The hydraulic retrieving tool of claim 9, wherein a deflective pad in the plurality comprises a rectangular, parallelogram, rhombus, or trapezoidal shape.

11. The hydraulic retrieving tool of claim 9, wherein the hydraulic retrieving tool comprises a sensor used to determine if the hydraulic retrieving tool accessed a lateral wellbore.

12. The hydraulic retrieving tool of claim 9, further comprising a drift subassembly coupled to the hydraulic retrieving tool and wherein lateral access is confirmed if the drift subassembly is able to drift at least a portion of the deflection surface of the deflector.

13. The hydraulic retrieving tool of claim 9, wherein the hydraulic retrieving tool further comprises an alignment key.

14. The hydraulic retrieving tool of claim 9, wherein the bullnose is a rounded convex shape.

15. A system for installing a deflector in a primary wellbore and confirming lateral wellbore access, the system comprising:

a hydraulic retrieving tool comprising:

a bullnose, a plurality of retractable deflective pads configured to be in an expanded state when positioned within the deflector, and a retractable dog configured to be in an expanded state when positioned within the deflector, and a mandrel coupled to at least one of the retractable dog and the plurality of deflective pads and configured to retract the deflective pads and the dog when pressurized; wherein the mandrel is configured to be pressurized when the hydraulic retrieving tool is being inserted or removed from the deflector; wherein the mandrel is configured to not be pressurized when the hydraulic retrieving tool is drifting the deflector or being run in the wellbore within the deflector;

the deflector comprising:

a deflection surface.

16. The system of claim 15, wherein a deflective pad in the plurality comprises a rectangular, parallelogram, rhombus, or trapezoidal shape.

17. The system of claim 15, wherein the hydraulic retrieving tool comprises a sensor used to determine if the hydraulic retrieving tool accessed the lateral wellbore.

18. The system of claim 15, further comprising a drift subassembly coupled to the hydraulic retrieving tool and wherein lateral access is confirmed if the drift subassembly is able to drift at least a portion of the deflection surface of the deflector.

19. The system of claim 15, wherein the hydraulic retrieving tool further comprises an alignment key.

20. The system of claim 15, wherein the bullnose is a rounded convex shape.

* * * * *